US007955413B2

(12) United States Patent
Becker et al.

(10) Patent No.: US 7,955,413 B2
(45) Date of Patent: Jun. 7, 2011

(54) METHOD OF PRODUCING TRANSFORMATION INDUCED PLASTICITY STEELS HAVING IMPROVED CASTABILITY

(75) Inventors: Jeffrey J. Becker, Pittsburgh, PA (US); Gerald E. Goldsmith, Riverside, IL (US); Simon N. Rodich, Valparaiso, IN (US); William K. Schlichting, Valparaiso, IN (US); Michael S. Wukich, Hebron, IN (US)

(73) Assignee: United States Steel Corporation, Pittsburgh, PA (US)

( * ) Notice: Subject to any disclaimer, the term of this patent is extended or adjusted under 35 U.S.C. 154(b) by 508 days.

(21) Appl. No.: 12/148,173

(22) Filed: Apr. 18, 2008

(65) Prior Publication Data

US 2008/0257110 A1 Oct. 23, 2008

Related U.S. Application Data

(60) Provisional application No. 60/925,611, filed on Apr. 23, 2007.

(51) Int. Cl.
*C22C 5/02* (2006.01)

(52) U.S. Cl. ..... 75/508; 148/334; 164/47

(58) Field of Classification Search ..... 75/508; 164/47; 148/334; 420/101, 111
See application file for complete search history.

(56) References Cited

U.S. PATENT DOCUMENTS

| | | | | |
|---|---|---|---|---|
| 4,152,140 | A | 5/1979 | Hori et al. | |
| 5,616,188 | A | 4/1997 | Kato et al. | |
| 2004/0154437 | A1 * | 8/2004 | Dittrich et al. | 75/508 |
| 2006/0162824 | A1 | 7/2006 | Merwin | |
| 2007/0272054 | A1 * | 11/2007 | Pleschiutschnigg et al. | 75/10.64 |

OTHER PUBLICATIONS

Hongbin Yin et al, In-situ Observations and Thermodynamics of the Chemical Reaction Between AIN Particles and Molten Slag, AISTech 2006 Proceedings vol. 1,pp. 753-759.
Aleksey A. Konieczny, On the Formability of Automotive TRIP Steels, Society of Autmotive Engineers, Inc. 2003-01-0521, 6 pages.
G. J. Kor, P. C. Glaws, The Making, Shaping & Treating of Steel, 1998 Ch. 11, p. 661.

* cited by examiner

*Primary Examiner* — George Wyszomierski
*Assistant Examiner* — Tima M McGuthry-Banks
(74) *Attorney, Agent, or Firm* — Edward H. Jones

(57) ABSTRACT

A method for producing Transformation Induced Plasticity (TRIP) steels comprises adding a degassing step to remove hydrogen and nitrogen prior to casting, resulting in a more fluid steel that exhibits improved castability.

2 Claims, 1 Drawing Sheet

METHOD OF PRODUCING TRANSFORMATION INDUCED PLASTICITY STEELS HAVING IMPROVED CASTABILITY

RELATED APPLICATION

This application incorporates in its entirety and claims the full benefit of provisional application 60/925,611 of the same title, filed on Apr. 23, 2007.

FIELD OF THE INVENTION

This invention relates to an improved method for producing Transformation Induced Plasticity (TRIP) steels. Specifically, the method comprises adding a degassing step not normally practiced with TRIP steel production to remove hydrogen and nitrogen, thus facilitating casting of the molten steel.

BACKGROUND OF THE INVENTION

TRIP steels are a class of advanced high-strength steels that have been gaining popularity in automotive applications due to their ductility and strength. Because TRIP steels are more ductile, they are easier to form than other steels with similar initial yield strengths. Yet TRIP steels have a much higher final part strength which makes them desirable in the production of automobile parts. TRIP steels are typically made up of three microconstituents: polygonal ferrite, bainite, and retained austenite. The retained austenite is present in the form of dispersed particles. The high strength of TRIP steels is due primarily to the presence of a substantial amount of the harder martensite and bainite microstructure phases dispersed in a relatively softer matrix of ferrite. The enhanced formability of TRIP steels (the ability to form parts of complex geometry) is due to the progressive transformation of the steel's retained austenite to the stronger martensite when plastic deformation is induced, such as during stamping. This phenomenon is known as transformation induced plasticity, or commonly referred to by the acronym "TRIP." Because of this enhanced formability, TRIP steels can be used to produce automobile parts having a more complex geometry than parts produced with other high-strength steels. This allows automobile manufacturers to exhibit more freedom in the design of automobile parts to optimize weight and structural performance. TRIP steels also exhibit greater strength at higher strain levels, making them ideal for crash energy management. Thus, TRIP steels are preferred where structural parts of medium to high strength and complex geometry requiring high formability in stamping are desired. TRIP steels are also ideal for automotive components requiring superior crash performance.

To achieve the combination of strength and formability, TRIP steels require a high alloy content. A typical TRIP steel composition generally includes (by wt. %) carbon 0.10-0.50; manganese 1.00-4.00, chromium 0.00-1.00; molybdenum 0.00-0.50; aluminum 1.00-5.00; titanium 0.00-0.20; niobium 0.00-0.20; and vanadium 0.00-0.20. The remainder of the composition is iron plus any unavoidable residuals present during the steelmaking process. Unfortunately, the compositions required to achieve the desired characteristics of TRIP steels also pose challenges in terms of continuous casting. Because of these compositions, continuous cast sequences of TRIP steels have historically been limited because of the necessity to terminate casting after a sequence of TRIP steel was produced. TRIP steels contain higher levels of aluminum, which tend to combine with certain components of the mold flux used in casting. The resulting combination causes a thick film to accumulate on the caster mold walls, deterring the flow of the molten steel. Hydrogen and nitrogen contained in the molten steel exacerbate the accumulation of the film. However, the present invention involves degassing the steel prior to casting to reduce the levels of hydrogen and nitrogen, resulting in a more flowable steel. This allows for longer cast sequences during TRIP steel production and also uninterrupted casting following transition to other steel grades.

BRIEF DESCRIPTION OF FIGURES

The present invention will become more fully understood from the figures.

SUMMARY OF THE INVENTION

Figure 1:
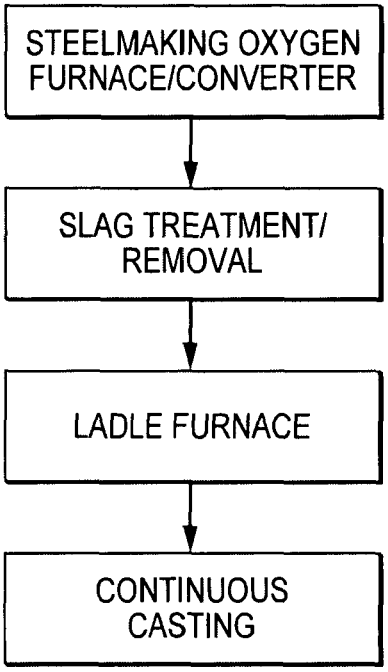
FIG. 1 PRIOR ART
FIG. 1 is a diagram showing the normal TRIP steel process flow known in the art.
Figure 2:
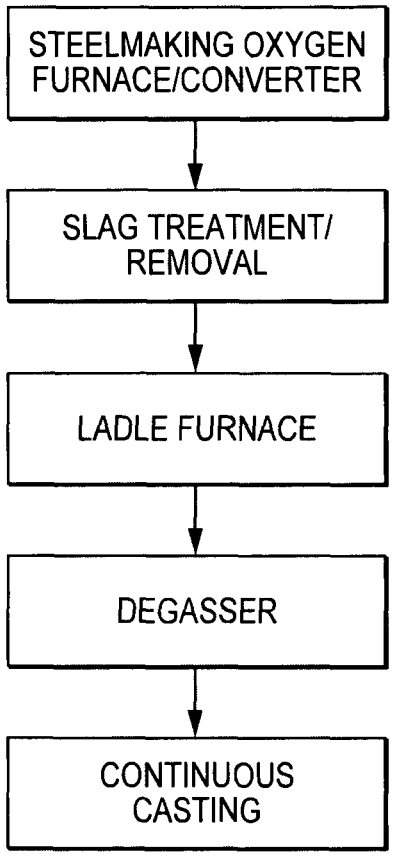
FIG. 2 is a diagram showing TRIP steel process flow according to the present invention.

Under a typical method of producing TRIP steel, batches of steel, or heats, are produced in a steelmaking basic oxygen furnace and tapped into a ladle. The steelmaking slag on top of the heat is either chemically treated or physically removed, then the heat is processed through a ladle metallurgy facility where additional alloys are added and the temperature is controlled. The fully processed heat is then transferred to the continuous caster, where it is cast into solidified thick slabs for further processing.

The present invention adds a step of degassing the steel prior to casting to remove hydrogen and nitrogen gases. Therefore, the method taught by the invention would comprise the steps of tapping the molten steel from a basic oxygen furnace or other steel furnace, removing any slag that may be present, refining the steel in ladle metallurgy facility, removing absorbed hydrogen and nitrogen gases in a degasser, and casting the molten steel.

Typically, degassing is used primarily for removing either carbon or hydrogen from steels to improve the performance of heavy-gauge products like pipe and structural plate. Newer classes of steels having ultra-low levels of carbon, such as interstitial-free steels, require degassing to remove carbon remaining from the steelmaking process. Nitrogen removal in a degasser, while practiced much less, is also known in the art. During processing, steel can absorb hydrogen and nitrogen from the atmosphere. Absorbed gases like hydrogen and nitrogen can cause undesirable effects once the steel solidifies. Hydrogen can cause embrittlement, low ductility, internal flaking and cracking, and subsurface blowholes, while nitrogen can adversely affect ductility and toughness. Methods to remove undesirable dissolved gases like hydrogen and nitrogen can involve either exposing the liquid steel to a low pressure environment (vacuum degassing), purging the liquid steel with an inert gas such as argon at normal atmospheric pressure (nonvacuum degassing), or a combination of both methods. However, the practice of degassing to remove hydrogen and nitrogen is not a practice typically carried out in the production of TRIP steels.

In high aluminum TRIP steels, the mold flux added during continuous casting is known to react with the aluminum in the molten steel. The result is a modified flux composition that forms a thick, solid film of "slag" on the walls of the caster mold that eventually prevents continuation of the cast. Thus, the lubrication function of the mold flux is effectively negated by the presence of aluminum in the steel. Moreover, hydrogen and nitrogen present in the steel exacerbate this undesirable effect. However, we have found that when heats of TRIP steel are processed in a degasser to remove hydrogen and nitrogen prior to the cast, the slag that forms on the caster mold walls is much thinner and more plastic (fluid). Thus, in the process of removing high detectable concentrations of undesirable gases from molten TRIP steel by employing traditional degassing methods prior to casting, we have found an unexpected result in that the degassed steel creates a more fluid slag that has been shown to possess improved castability. Degassing prior to casting allows the cast to continue uninterrupted through additional heats of TRIP steel. Degassing also facilitates the transition to casting non-TRIP grades of steel.

We claim:

1. A method for producing Transformation Induced Plasticity (TRIP) steels having improved castability, said method comprising:

producing molten TRIP steel in a basic oxygen furnace (BOF), eliminating any slag buildup from the molten steel, processing the molten steel in a ladle metallurgy facility, removing gases from the molten steel in a degasser to make the steel more flowable, and casting the more flowable steel into a solid form.

2. The method of claim 1, wherein the gases removed are hydrogen and nitrogen.

* * * * *